United States Patent [19]

DeKoster et al.

[11] Patent Number: 4,739,292

[45] Date of Patent: Apr. 19, 1988

[54] MINIATURE RELAY

[75] Inventors: Heinz DeKoster, Stamford; Oscar Edelman; Nathan H. Magida, both of Westport, all of Conn.

[73] Assignee: Thermosen, Incorporated, Stamford, Conn.

[21] Appl. No.: 938,973

[22] Filed: Dec. 8, 1986

[51] Int. Cl.[4] ..... H01H 51/22

[52] U.S. Cl. ..... 335/80; 335/151; 200/275

[58] Field of Search ..... 335/80, 81, 82, 83, 335/84, 85, 86, 151, 154, 236, 202, 128; 200/275

[56] References Cited

U.S. PATENT DOCUMENTS 3,544,930 12/1970 Sauer ..... 335/154

4,063,203 12/1977 Fujiwara et al. ..... 335/154

4,472,699 9/1984 Fujii et al. ..... 335/85

*Primary Examiner*—E. A. Goldberg

*Assistant Examiner*—Lincoln Donovan

*Attorney, Agent, or Firm*—Parmelee, Bollinger & Bramblett

[57] ABSTRACT

A miniature switch has superior ability to switch small signals with high efficiency. A capsule encloses the switching contacts, the moving contact being provided with a magnetically permeable armature. A pair of magnetic pole pieces extend into the capsule and form an air gap closely adjacent the armature. When a magnetic field is applied across the air gap between the pole pieces, the armature is actuated and initiates the switching action.

9 Claims, 4 Drawing Sheets

MINIATURE RELAY

TECHNICAL FIELD

This invention relates to electrical relays and, more particularly, to miniaturized relays capable of switching low level signals with high precision.

BACKGROUND ART

A conventional dry reed switch comprises a single magnetic blade which extends into a glass cylinder from one end and another which extends from the opposite end. The two reeds are opposed to each other in the center, or toward one end, of the glass capsule. To create a relay, an electrical coil is slipped over one or more glass cylinders but there is no additional magnetic closure. The magnetic system is essentially wide open and has a very large external air gap. As a result, it has a low magnetic efficiency which reduces the reliability and the sensitivity of the switching action. In addition, the switches used in such a relay are limited in that only magnetic materials may be used for the reeds. This precludes the use of many materials which might be preferred as electrical switching elements.

DISCLOSURE OF INVENTION

The invention comprises a non-magnetic, electrically non-conductive housing which defines a contact chamber. At least one stationary and one movable electrical contact are contained within the chamber. Secured to the moving contact is a magnetic armature. the housing is encircled by a coil which produces a magnetic flux when energized. The flux flows in a closed magnetic path that ends in two opposed pole pieces inside the contact chamber. The pole pieces form an air gap closely adjacent the armature.

BEST MODE FOR CARRYING OUT THE INVENTION

Figure 1:
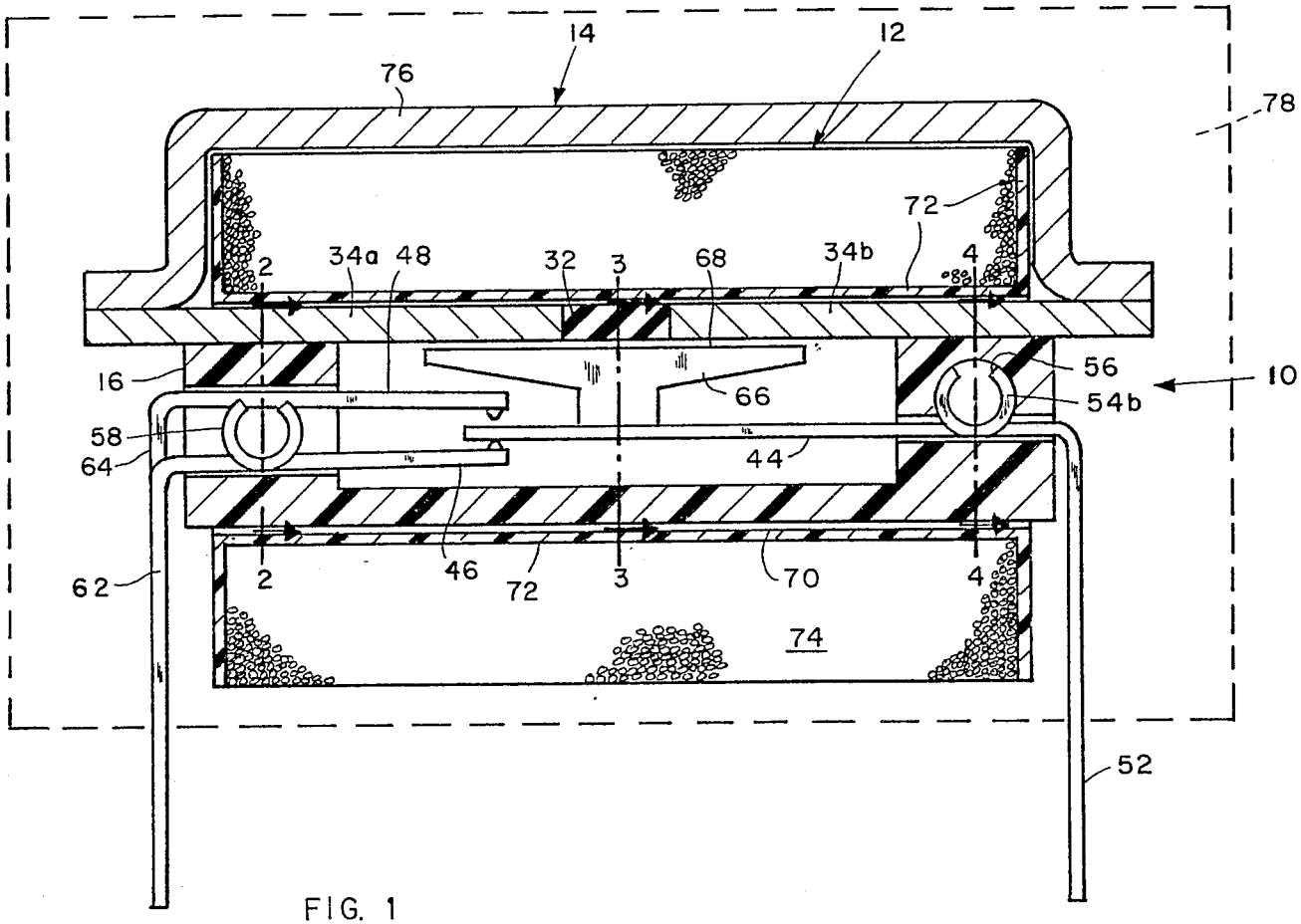
FIG. 1 is a longitudinal cross-section through a relay constructed in accordance with this invention, an encapsulant being indicated by the dotted line.
Figure 2:
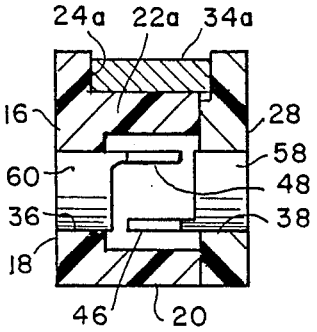
FIG. 2 is a cross-section taken substantially along the line 2—2 of FIG. 1 but omitting the coil and return magnetic path.
Figure 3:
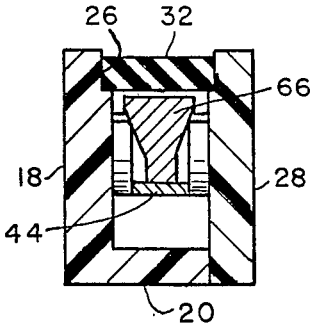
FIG. 3 is a similar cross-section taken substantially along the line 3—3 of FIG. 1.

With particular reference to FIGS. 1–4, there is illustrated a relay in accordance with the invention which comprises a central capsule assembly 10, an operating coil assembly 12, and a magnetic return path assembly 14.

The capsule assembly 10 comprises a housing which encloses the electrical contacts and part of the magnetic circuit. It is made of electrically insulating material and comprises a main housing member 16 which includes an elongated rectangular sidewall 18. Extending from the sidewall 18, along its length, is a horizontal base 20. Also extending from the sidewall 18, but spaced above and parallel to base 20, are a pair of shelf members **22*a*, 22*b* located at opposite ends of the sidewall 18. The shelf members 22*a*, *b* are aligned with one another and positioned below the top edge of the sidewall 18 so as to form recesses 24*a*, *b* which are interconnected by a cutaway portion 26 of sidewall 18 between the shelf members 22*a*, 22*b*. The opposite side of the capsule assembly 10 is closed by a side plate 28 which includes a cutaway portion 30 matching that in the main housing member 16. A pair of pole pieces 34*a*, 34*b* extend across the top of the capsule assembly 10 from opposite ends. The gap between the pole pieces is closed by a strip 32 of non-magnetic, electrically insulating material. At one end of the capsule assembly 10, the side wall 18 and the side plate 28 define a pair of aligned circular openings 36, 38. At the opposite end of the capsule assembly, these same members define a second pair of openings 40, 42**.

Figure 4:
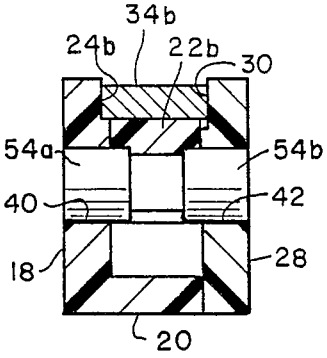
FIG. 4 is a similar cross-section taken substantially along the line 4—4 of FIG. 1.
Figure 7:
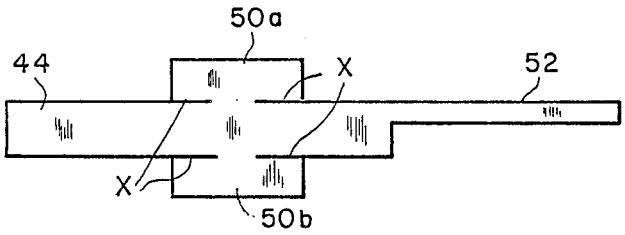
FIG. 7 is a top view of a blank for forming a relay contact having two integral roll pins.
Figure 8:
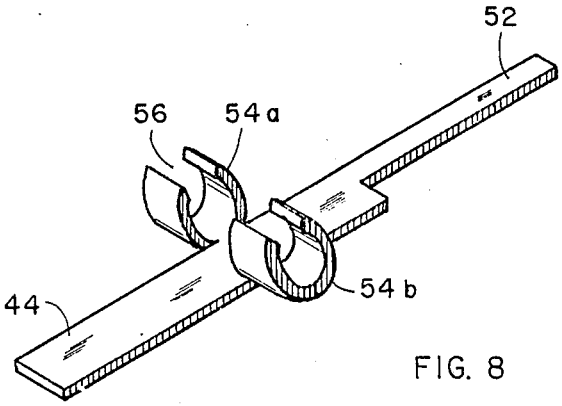
FIG. 8 is a perspective view of a two roll pin contact formed from the blank of FIG. 7.

Enclosed within the housing portion of the capsule assembly 10 are a movable reed 44, a normally closed contact 46, and a normally open contact 48. Referring now to FIGS. 7 and 8, the formation of the reed 44 will be explained. FIG. 7 illustrates a blank formed from a suitable electrically conductive material such as copper. It comprises a rectangular reed 44, a pair of projecting side wings **50*a*, 50*b* and a narrow extension 52. Cut lines are indicated by the letter X. The side wings 50*a*, 50*b* are rolled into partial cylinders, as illustrated in FIG. 8, to form a pair of roll pins 54*a*, *b* defining gaps 56. During assembly of the capsule housing, the roll pins 54*a*, 54*b* are inserted into the openings 40, 42 as shown in FIG. 4. The extension 52** serves as an electrical terminal and may be bent into any desired position.

The normally closed and normally open fixed contacts 46, 48 are fashioned in a similar manner but with only one roll pin apiece. Thus, contact 46 includes a roll pin 58 which is inserted into the opening 38 and contact 48 includes a roll pin 60 which is inserted into the opening 36. The contacts 46, 48 are identical but are installed in reversed relationship. Each includes an extension 62, 64 as an electrical terminal. Secured to the reed 44, by any desirable means, is a magnetically permeable armature 66 having a relatively long planar upper surface 68.

To provide electrostatic shielding, the capsule assembly 10 is encircled with a material such as a metallized film 70 of the type employed in the manufacture of capacitors. This provides a shield which is electrically conductive but does not form a shorted turn. Mounted over the capsule assembly 10 and film 70 is a bobbin 72 which carries in electromagnetic coil 74 to form the coil assembly 12.

As has been previously explained, the magnetically permeable pole pieces **34*a*, 34*b* extend into the capsule assembly 10 from either end. Their separated ends are positioned immediately above, and closely adjacent, the armature surface 68 as will be apparent from FIG. 1. The magnetic path assembly 14 is completed by a return strap 76 of magnetically permeable material which is curved around the coil assembly 12 into a U shape with its ends welded to the ends of the pole pieces 34***a*, 34*b* as illustrated in FIG. 1. After assembly is completed, the relay may be enclosed in an encapsulant 78.

Figure 9:
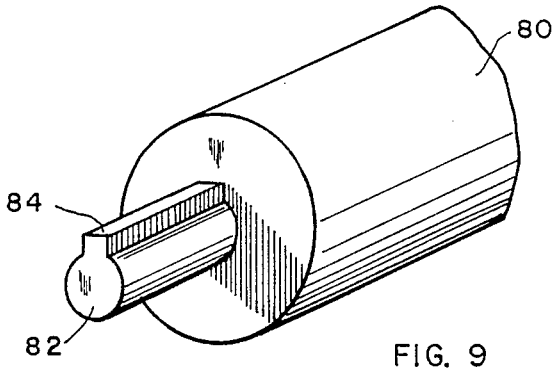
FIG. 9 is a perspective view showing the end of a tool for adjusting the relay contact.

During the manufacture of the relay of this invention, it is probable that minor adjustments may need to be made to the contacts prior to its being encapsulated. This is achieved by means of the tool shown in FIG. 9. This tool comprises a shank 80 from which extends a small pin 82 which is of a size just to enter the roll pins 54, 58, 60. Extending radially from the pin 82 is a key 84 which is dimensioned to fit within the slot 56 of each of the roll pins. Rotation of the tool will thereupon rotate the roll pin and its corresponding contact into the desired position. As the roll pins are designed to fit snugly within their respective openings, friction will hold them in place until they are permanently epoxyed or otherwise secured.

Many advantages result from the structure described above. The magnetic system is very efficient in that the air gaps are short. There is an essentially zero-length air gap between the return path of strap 76 and the pole pieces 34*a*, 34*b* to which it is welded. The internal air gaps, which are those between pole pieces 34*a*, 34*b* and the armature 66, are quite small and are of large area compared to the total structure. This means that the overall reluctance of the system is quite low which improves the magnetic efficiency. As a result, substantially more force is available in the mechanical structure than is true of existing reed relays. This permits increased gaps between the contacts which allow increased motion of the moving contact and increased contact forces. Furthermore, this can be obtained with much less coil power for driving the relay than is true of existing relays.

Another advantage of the tightly closed magnetic system of the relay of this invention is that it is quite independent of external magnetic fields. In other words, a permanent magnet may be brought fairly close to the relay without having any effect, whereas doing the same thing with a magnetically unshielded prior art reed relay will change its operating characteristics radically. The electrostatic shield formed by film 70 isolates the switching contacts from extraneous electrostatic fields.

Another advantage of the relay of the invention is that any type of electrically conductive material may be used for the contacts, including the movable reed 44.

EXAMPLE

A single capsule relay similar to that of FIG. 1 was constructed. Its overall length (unencapsulated) was 0.7 in. and its height 0.36 in. The switching contacts were 0.01 in. thick copper with gold-inlaid contact surfaces. The pole pieces and return magnetic path were of soft iron, 0.025 in. thick and 0.08 in. wide. The gap between the pole pieces was 0.06 in. The armature was also of soft iron and its upper surface measured 0.25 in. $\times$ 0.0645 in. The gap between it and the pole pieces, unenergized, was 0.007 in. The coil consisted of 3300 turns of 43.5 AWG wire. Coil current required to move the armature was 9 ma. When energized with 10 volts applied to the coil, switching, including bounce, was complete within 1.5 milliseconds.

Figure 5:
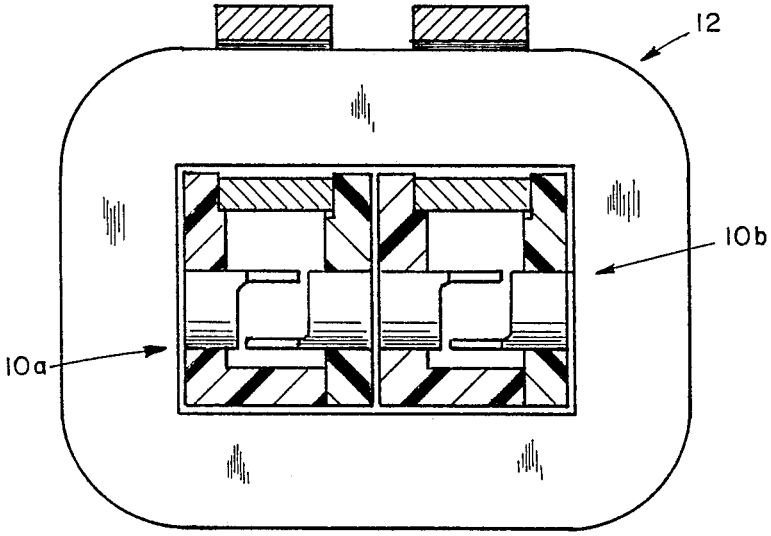
FIG. 5 is a lateral cross-section through a dual relay assembly.
Figure 6:
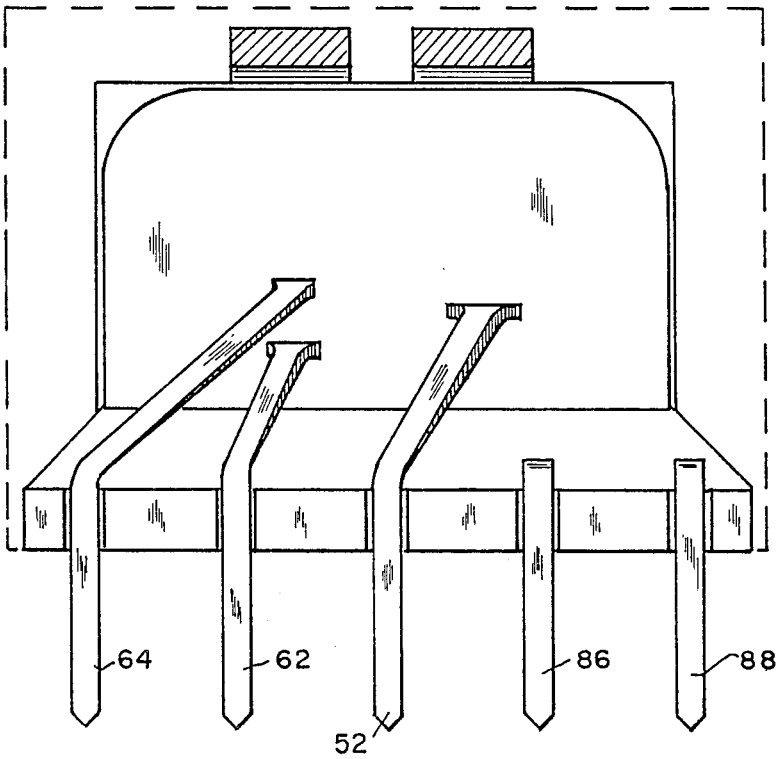
FIG. 6 is an end view of a two capsule relay illustrating one type of formed contact pins.
Figure 10:
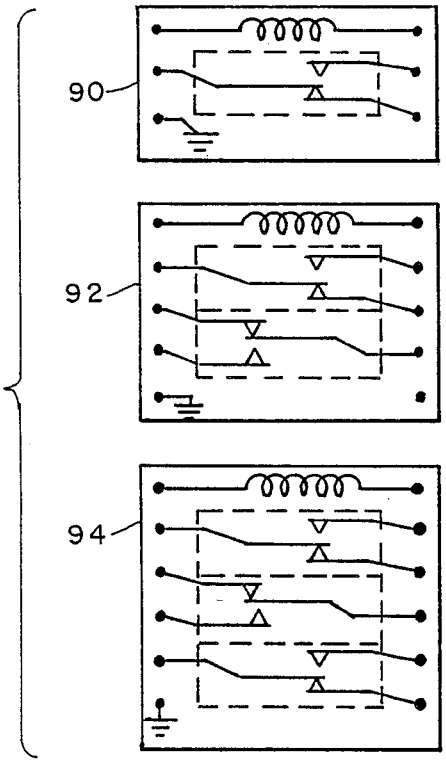
FIG. 10 is three circuit diagrams of one, two, and three capsule relays.

A number of variations and modifications may be made in this invention. For example, illustrated in FIG. 5 is a multiple version wherein two capsules 10*a*, 10*b* are enclosed within a single coil assembly 12′. As viewed in FIG. 6, the contact extensions 52, 62, 64 are bent downwardly to form pins which, together with pins 86, 88 from the operating coil, may plug into a standard dual in-line plug. Alternatively, these contact extensions and leads may be connected to a lead frame to provide such pins. Any number of these units may be combined. FIG. 10 illustrates circuit diagrams for a single capsule relay 90, a dual capsule relay 92, and a triple capsule relay 94.

In the various embodiments of the invention described above, the capsule assembly 10 is enclosed within an operating coil and employs a magnetic return path around the coil. However, the operating coil is not a necessary feature of the invention. There are a number of applications in which the capsule assembly, including the pole pieces 34*a*, 34*b* but omitting the return strap 76, would be usable. For example, the switch could be activated by an external movable magnet coming into close relationship with the pole pieces. Other applications of the capsule assembly will suggest themselves to those skilled in the art.

It will also be apparent that many other variations and modifications may be made in this invention without departing from its spirit and scope. Accordingly, the foregoing description is to be construed as illustrative only, rather than limiting. This invention is limited only by the scope of the following claims.

We claim:

1. A miniature magnetically operable switch which comprises:

a non-magnetic, electrically non-conductive housing defining a contact chamber and having a circular opening therethrough;

at least one stationary electrical contact within said chamber;

at least one movable electrical contact within said chamber engageable with said stationary contact;

at least one of said movable and stationary contacts comprising a reed having an integral, substantially cylindrical rollpin extending therefrom and received in the circular opening in said housing;

first and second magnetic pole pieces within said chamber separated by an air gap;

a magnetic armature secured to the movable electrical contact, spanning the air gap, and engageable with both of said pole pieces to complete a magnetic circuit and actuate the movable contact when a magnetic field is applied across the air gap between said pole pieces; and means for connecting the stationary and movable electrical circuit.

2. A miniature magnetically operable switch which comprises:

a non-magnetic, electrically non-conductive housing defining a contact chamber and a plurality of circular openings therethrough;

at least one stationary electrical contact within said chamber comprising a reed having an integral, substantially cylindrical rollpin extending therefrom including a slot extending longitudinally therethrough, said rollpin being received within one of the circular openings in said housing;

at least one movable electrical contact within said chamber engageable with said stationary contact and comprising a reed having an integral, substantially cylindrical rollpin extending therefrom including a slot extending longitudinally therethrough, said rollpin being received within another one of the circular openings in said housing;

first and second magnetic pole pieces within said chamber separated by an air gap;

a magnetic armature secured to the movable electrical contact, spanning the air gap, and engageable with both of said pole pieces to complete a magnetic circuit and actuate the movable contact when a magnetic field is applied across the air gap between said pole pieces; and means for connecting the stationary and movable contacts to an external electrical circuit.

3. A miniature magnetically operable switch which comprises:

a non-magnetic, electrically non-conductive housing defining a contact chamber;

at least one stationary electrical contact within said chamber;

at least one movable electrical contact within said chamber engageable with said stationary contact;

first and second magnetic pole pieces within said chamber separated by an air gap;

a magnetic armature secured to the movable electrical contact, spanning the air gap, and engageable with both of said pole pieces to complete a magnetic circuit and actuate the movable contact when a magnetic field is applied across the air gap between said pole pieces;

a switching coil surrounding said housing to actuate said magnetic armature;

an electrostatic shield between said housing and said coil; and means for connecting the stationary and movable contacts to an external electrical circuit.

4. The switch of claim 1 wherein the rollpin includes a slot extending longitudinally through its cylindrical wall.

5. The switch of claim 4 additionally including a contact adjustment tool comprising:

a pin insertable into the cylindrical rollpin;

a key carried by the pin and extending into said slot when the pin is so inserted; and means for rotating said pin to adjust the position of said reed.

6. The switch of claim 5 wherein the rotating means comprises a handle.

7. The switch of claim 3 wherein said electrostatic shield comprises an electrically insulating sheet having an electrically conductive coating thereon.

8. The switch of claim 7 wherein said electrostatic shield comprises a metallized film.

9. The switch of claim 7 wherein said coating is a metal foil.

* * * * *